US005204584A

United States Patent [19]

Ikeda et al.

[11] Patent Number: 5,204,584

[45] Date of Patent: Apr. 20, 1993

[54] LOW PRESSURE MERCURY VAPOR DISCHARGE LAMP

[75] Inventors: Toshiyuki Ikeda, Kanuma; Masao Nagai, Yokohama, both of Japan

[73] Assignee: Toshiba Lighting & Technology Corporation, Tokyo, Japan

[21] Appl. No.: 763,305

[22] Filed: Sep. 20, 1991

[30] Foreign Application Priority Data

Sep. 28, 1990 [JP] Japan ..... 2-258917

[51] Int. Cl.[5] ..... H01J 61/20; H01J 61/42

[52] U.S. Cl. ..... 313/565; 313/490

[58] Field of Search ..... 313/490, 565

[56] References Cited

U.S. PATENT DOCUMENTS 4,047,071 9/1977 Busch et al. ..... 313/490
4,093,889 6/1978 Bloem et al. ..... 313/490 X
4,972,118 11/1990 Yorifuji et al. ..... 313/490 X
5,055,738 10/1991 Yorifuji et al. ..... 313/490

FOREIGN PATENT DOCUMENTS 47-44976 12/1972 Japan .
277147 12/1986 Japan ..... 313/490
2-13421 4/1990 Japan .

*Primary Examiner*—Palmer C. DeMeo
*Attorney, Agent, or Firm*—Cushman, Darby & Cushman

[57] ABSTRACT

A low pressure mercury vapor discharge lamp having a suitable combination of a main amalgam and an auxiliary amalgam. The main amalgam has a mercury vapor pressure not less than a third as much as a mercury vapor pressure of pure mercury at a temperature between 0° C. and 50° C. The auxiliary amalgam has a mercury vapor pressure not less than a third as much as the mercury vapor presure of said main amalgam at a temperature between 0° C. and 50° C. Such a combination is advantageous in that the mercury vapor pressure of the lamp is maintained at a certain level in the low and middle tube wall temperature area and that the luminous output is maintained at a high level in that temperature area, and also that the increasing speed of luminous flux of lamps using these amalgams during a starting period (a luminous flux increasing characteristic) is fast nevertheless, in the low and middle tube wall temperature area.

17 Claims, 2 Drawing Sheets

LOW PRESSURE MERCURY VAPOR DISCHARGE LAMP

BACKGROUND OF THE INVENTION

1. Field of the Invention

The present invention relates to a low pressure mercury vapor discharge lamp having a main amalgam for controlling the mercury vapor pressure in the tube of the lamp except for a starting period and having an auxiliary amalgam for controlling the mercury vapor pressure in the tube of the lamp for the starting period. In particular, the invention relates to a low pressure mercury vapor discharge lamp designed to operate in a relatively low to middle tube wall temperature area.

2. Description of the Related Art

It is well known that an amalgam can control the mercury vapor pressure of a low mercury vapor pressure discharge lamp at a certain proper level even if the lamp has high tube wall temperature and cannot control the mercury vapor pressure without the amalgam (pure mercury). Therefore, the amalgams are used in the lamps which have high tube wall temperature at their operation, for example, compact flourescent lamps which have bent tubes forming convoluted discharge paths. These lamps have high wall loads (more than 500 $W/m^2$), and thus have high tube wall temperatures of about 80°-120° C. The amalgam used in these lamps, in other words, the amalgam used in the high tube wall temperature area, is usually bismuth-indium-mercury (Bi-In-Hg) amalgam. The lamps using the bismuth-indium-mercury (Bi-In-Hg) amalgams have an advantage in that the mercury vapor pressures of the lamps are maintained at a certain proper level and the luminous outputs are maintained at a high level.

However, these lamps using the bismuth-indium-mercury (Bi-In-Hg) amalgams have a disadvantage in that the increasing speed of luminous flux of lamps using these amalgams in a starting period (a luminous flux increasing characteristic) is low as compared with lamps not using amalgams. The reason is as follows. The mercury vapor pressure of the bismuth-indium-mercury (Bi-In-Hg) amalgam is lower than that of the pure mercury, and thus reaches a proper level in a high tube wall temperature area. But the mercury vapor pressure becomes too low in a low and middle tube wall temperature area of about 0°-50° C., where the mercury vapor pressure of the pure mecury is a proper level. The tube wall temperature is low for the starting period, and thus the mercury vapor pressure of the bismuth-indium-mercury (Bi-In-Hg) amalgam is low for the starting period.

To eliminate the above disadvantage, an auxiliary amalgam is added to the lamp and located near the electrode of the lamp so that the auxiliary amalgam emits mercury for the starting period. Usually, a conventional auxiliary amalgam is indium-mercury (In-Hg) amalgam. The bismuth-indium-mercury (Bi-In-Hg) amalgam for controlling the mercury vapor pressure of the lamp is called a main amalgam in contrast with the auxiliary amalgam. The auxiliary amalgam is heated by the electrode after the ignition of the lamp and emits mercury vapor in the tube of the lamp. The mercury vapor emitted from the auxiliary amalgam makes up for the lack of the mercury vapor in the starting period.

Furthermore, an amalgam applied for the lamp used in the low and middle tube wall temperature area is developed. For example, bismuth-indium-lead-mercury (Bi-In-Pb-Hg) amalgam and bismuth-lead-mercury (Bi-Pb-Hg) amalgam is disclosed in U.S. Pat. No. 4,972,118.

The bismuth-indium-lead-mercury (Bi-In-Pb-Hg) amalgam and the bismuth-lead-mercury (Bi-Pb-Hg) amalgam are used not only for the purpose of controlling the mercury vapor pressure in the tube of the lamp, but also for the purpose of keeping a certain amount of the mercury sealed in the tube of the lamp. The mercury vapor pressures of these amalgams are higher than that of the bismuth-indium-mercury (Bi-In-Hg) amalgam and are lower than that of the pure mercury. The mercury vapor pressures of these amalgams are similar to that of pure mercury in the low and middle tube wall temperature area.

However, when the auxiliary amalgam made of the indium-mercury (In-Hg) amalgam is provided to the lamp having the bismuth-indium-lead-mercury (Bi-In-Pb-Hg) amalgam or the bismuth-lead-mercury (Bi-Pb-Hg) amalgam provided as a main amalgam, the lamp shows the above mentioned disadvantage in that the luminous flux increasing characteristic is almost as bad in the low and middle tube wall temperature area as the lamp not having the auxiliary amalgam. In other words, the lamp having the main amalgam such as the bismuth-indium-lead-mercury (Bi-In-Pb-Hg) amalgam or the bismuth-lead-mercury (Bi-Pb-Hg) amalgam and the auxiliary amalgam such as the indium-mercury (In-Hg) amalgam has an advantage in that the mercury vapor pressure of the lamp is maintained at a certain proper level in the low and middle tube wall temperature area and that the luminus output is maintained at a high level in that temperature area, but this lamp has a disadvantage in that the luminous flux increasing characteristic is bad in the low and middle tube wall temperature area. This lamp has also a disadvantage in that the tube wall of the lamp has dark spots and dark bands near the electrodes early in its life (a blackening phenomena).

SUMMARY OF THE INVENTION

Accordingly, it is an object of the present invention to provide suitable combinations of a main amalgam and an auxiliary amalgam used in a low pressure mercury vapor discharge lamp.

To accomplish the object described above, the present invention provides a low pressure mercury vapor discharge lamp comprising:

a tube forming a discharge space therein containing a discharge gas which includes a mercury vapor;

a pair of electrodes provided to the tube, apart from each other;

a main amalgam sealed in the tube for controlling the mercury vapor pressure in the tube, the main amalgam having a mercury vapor pressure not less than a third as much as the mercury vapor pressure of pure mercury at a temperature of between 0° C. and 50° C.; and an auxiliary amalgam sealed in the tube and located closer to the one of the electrodes than the main amalgam, the auxiliary amalgam having a mercury vapor pressure not less than a third as much as the mercury vapor pressure of the main amalgam at a temperature of between 0° C. and 50° C.

DETAILED DESCRIPTION OF THE PREFERRED EMBODIMENTS

Figure 1:
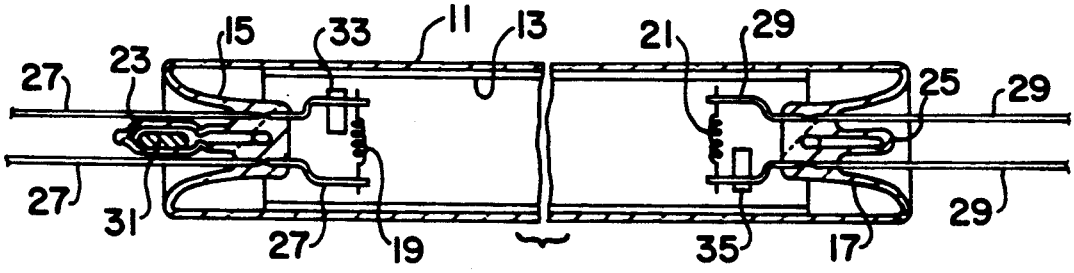
FIG. 1 is a front sectional view of a fluorescent lamp according to a first embodiment of the present invention.

Referring to the accompanying drawings, embodiments of the present invention will be described. However, in the drawings, the same numerals are applied to similar elements in the drawings, and therefore the detailed descriptions thereof will not be repeated.

FIG. 1 is a front sectional view of a fluorescent lamp according to a first embodiment of the present invention. The fluorescent lamp has a straight glass main tube 11 and a fluorescent layer 13 coated on the inner surface of the main tube 11. The main tube 11 forms a discharge space therein. The main tube 11 has a pair of stems 15 and 17 with electrodes 19 and 21 and thin tubes 23 and 25. Accordingly, the main tube 11 has a discharge path between both electrodes 19 and 21. The electrodes 19 and 21 are formed in a filament coil type. One of the thin tubes 23 and 25 is used for an exhaust tube. Each electrode 19, 21 is supported by a pair of lead wires 27, 29, respectively. A certain amount of mercury as a discharge gas and also a certain amount of argon gas as a starting gas are filled in the main tube 11. Although the main tube 11 is a straight type as mentioned above, it may be another shape such as a circle shape, U-shape, W-U-shape, H-shape and so on.

The thin tube 23 has an main amalgam 31 therein. The main amalgam 31 is, for example, bismuth-lead-mercury (Bi-Pb-Hg) amalgam or bismuth-tin-mercury (Bi-Sn-Hg) amalgam whose mercury vapor pressure is not less than a third as much as a mercury vapor pressure of pure mercury in an area between 0° C. and 50° C. Details of the main amalgam 31 are explained later. It is necessary for the main amalgam 31 to have a mercury vapor pressure characteristic close to that of pure mercury in the low and middle temperature area.

A pair of auxiliary amalgam members 33 and 35 are supported near each electrode 19 or 21 by the lead wires 27 and 29. Each auxiliary amalgam member 33 or 35 is composed of a nickel leaf and an auxiliary amalgam coated on the surface of the nickel leaf. Each nickel leaf is 7 mm in length, 2 mm in width and 0.03 mm in thickness. The auxiliary amalgam is for example, bismuth-indium-lead-mercury (Bi-In-Pb-Hg) amalgam whose mercury vapor pressure is not less than a third as much as the mercury vapor pressure of said main amalgam 31 in an area between 0° C. and 50° C. It is necessary for the auxiliary amalgam to have a mercury vapor pressure characteristic close to that of the main amalgam in the low and middle temperature area.

Figure 2:
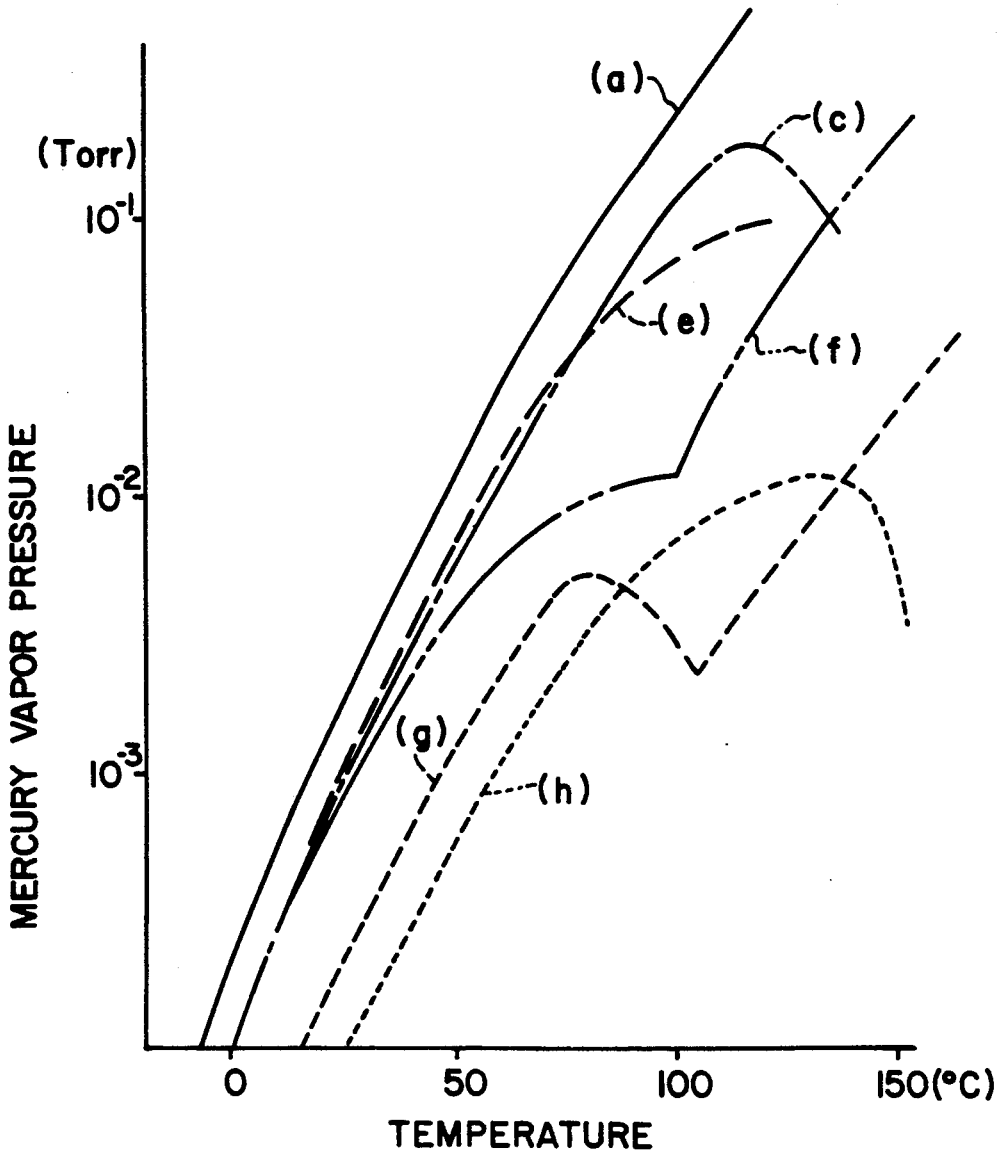
FIG. 2 is a graph showing a relation between a mecury vapor pressure and a temperature.

Table I shows compositions of the amalgams which are used as main amalgams or as auxiliary amalgams in the lamp of the present invention. FIG. 2 is a graph showing a relation between a mercury vapor pressure and a temperature with regards to the amalgams shown in the table I.

TABLE I

| a sign | an amalgum composition | note |
|---|---|---|
| a | pure mercury | |
| b | Bi(49%)—Sn(36%)—Hg(15%) | not shown |
| c | Bi(55%)—Sn(41%)—Hg(4%) | |
| d | Bi(49%)—Pb(36%)—Hg(15%) | not shown |
| e | Bi(55%)—Pb(41%)—Hg(4%) | |
| f | Bi(52%)—In(3%)—Pb(42%)—Hg(3%) | |
| g | Bi(64.5%)—In(31.5%)—Hg(4%) | |
| h | In(90%)—Hg(10%) | |

According to the FIG. 2, it is understood that the Bi(55%)-Sn(41%)-Hg(4%) amalgam (sample (c)) and Bi(55%)-Pb(41%)-Hg(4%) amalgam (sample (e)) have a mercury vapor pressure characteristic which is close to that of the pure mercury (sample (a)) in the low and middle temperature area (0°-50° C.). Thus these amalgams are suitable for the low and middle temperature area. The larger amount of mercury the Bi-Sn-Hg amalgam and Bi-Pb-Hg amalgam have, for example samples (b) and (d), the closer to that of the pure mercury the mercury vapor pressure of the Bi-Sn-Hg amalgam and Bi-Pb-Hg amalgam becomes.

The Bi(64.5%)-In(31.5%)-Hg(4%) amalgam (sample (g)) and the In(90%)-Hg(10%) amalgam (sample (h)) have a much lower mercury vapor pressure than the pure mercury, and thus these are suitable for the high temperature area (80°-120° C.). The mercury vapor pressure of the Bi(52%)-In(3%)-Pb(42%)-Hg(3%) amalgam (sample (f)) is close to that of pure mercury in the low and middle temperature area and is close to that of the Bi(64.5%)-In(31.5%)-Hg(4%) amalgam (sample (g)) or the In(90%)-Hg(10%) amalgam (sample (h)) in the high temperature area. Therefore the Bi(52%)-In(3%)-Pb(42%)-Hg(3%) amalgam (sample (f)) has a intermediate characteristic, and is suitable for both the low and middle temperature area and the high temperature area.

With regards to lamps using these amalgams of the Table I as main amalgams and auxiliary amalgams, luminous fluxes, increasing speeds of luminous fluxes in a starting period, and ignition characteristics in the low and middle temperature area (0°-50° C.) and in the high temperature area (80°-120° C.) were measured, respectively. The ignition characteristic means whether or not the lamp using the amalgam easily begins to discharge. It was also measured whether or not the blackening happened when the lamp began to discharge under in a low temperature area. The lamps of the samples (i), (j), (k) are conventional.

TABLE II

| | | | luminous flux | | increasing speed of luminous flux | | ignition characteristic | | |
|---|---|---|---|---|---|---|---|---|---|
| a sign | a main amalgam | an auxiliary amalgam | a high temp. area | a low and middle temp. area | a high temp. area | a low and middle temp. area | a high temp. area | a low and middle temp. area | blackening at low temp. area |
| i | none | none | x | ○ | ○ | Δ | ○ | ○ | ○ |
| j | Bi—In—Hg | In—Hg | ○ | x | ○ | x | ○ | x | x |
| k | Bi—Pb—Hg(4%) | none | Δ | ○ | ○ | Δ | ○ | ○ | ○ |

TABLE II-continued

| a sign | a main amalgam | an auxiliary amalgam | luminous flux: a high temp. area | luminous flux: a low and middle temp. area | increasing speed of luminous flux: a high temp. area | increasing speed of luminous flux: a low and middle temp. area | ignition characteristic: a high temp. area | ignition characteristic: a low and middle temp. area | blackening at low temp. area |
|---|---|---|---|---|---|---|---|---|---|
| l | Bi—Pb—Hg(4%) | In—Hg | Δ | ○ | ○ | x | ○ | x | x |
| m | Bi—In—Pb—Hg(3%) | In—Hg | ○ | ○ | ○ | x | ○ | x | x |
| n | Bi—Pb—Hg(4%) | Bi—In—Pb—Hg | Δ | ○ | ○ | ○ | ○ | ○ | ○ |
| o | Bi—Pb—Hg(15%) | Bi—In—Pb—Hg | x | ○ | ○ | ○ | ○ | ○ | ○ |
| p | Bi—In—Pb—Hg(3%) | Bi—In—Hg | ○ | ○ | ○ | ○ | ○ | Δ | Δ |
| q | Pb—Sn—Hg(4%) | Bi—In—Pb—Hg | Δ | ○ | ○ | ○ | ○ | ○ | ○ |
| r | Pb—Sn—Hg(15%) | Bi—In—Pb—Hg | Δ | ○ | ○ | ○ | ○ | ○ | ○ |
| s | Pb—Sn—Hg(4%) | none | Δ | ○ | ○ | Δ | ○ | ○ | ○ |

○: good
Δ: intermediate
x: no good

Results are shown in the table II. According to the table II, the lamps using the Bi-Sn-Hg amalgam, the Bi-Pb-Hg amalgam, or the Bi-In-Pb-Hg amalgam as a main amalgam are good in luminous flux in the low and middle temperature area (samples (k)–(s) in the Table II) same as the lamp not using amalgams (sample (i)). The lamp using the Bi-Pb-Hg(15%) amalgam as a main amalgam is not good in luminous flux in the high temperature area (sample (o) in the Table II) same as the lamp not using amalgams (sample (i)). The lamps using the Bi-In-Pb-Hg amalgam as a main amalgam are good in luminous flux in the high temperature area (samples (m), (p)), same as the lamp using the Bi-In-Hg amalgam (sample (j)). The lamps using the Bi-Pb-Hg(4%) amalgams (samples (k), (l), (n)) and the Bi-Sn-Hg amalgams (samples (q), (r), (s)) as a main amalgam have intermediate characteristics in luminous flux between the lamp not using amalgams and the lamp using the Bi-In-Pb-Hg amalgam as a main amalgam.

These luminous fluxes of lamps are determined by the mercury vapor pressure characteristics of main amalgams. The luminous flux depends on the mercury vapor pressure in the tube and a low mercury vapor pressure discharge lamp shows its maximum value in luminous flux near $6\times10^{-3}$ Torr in mercury vapor pressure in the tube. Therefore, the closer the lamp becomes to $6\times10^{-3}$ Torr in mercury vapor pressure in the tube, the better characteristic the lamp has in luminous flux.

Accordingly, it is necessary for the main amalgam to have a mercury vapor pressure characteristic which is similar to the mercury vapor pressure characteristic of pure mercury in the low and middle temperature area for the purpose of using the main amalgam instead of using pure mercury for the lamp used in the low and middle temperature area (0° C.–50° C.). Therefore, it is necessary for the main amalgam to have a mercury vapor pressure not less than a third as much as a mercury vapor pressure of pure mercury in the low and middle temperature area.

Figure 3:
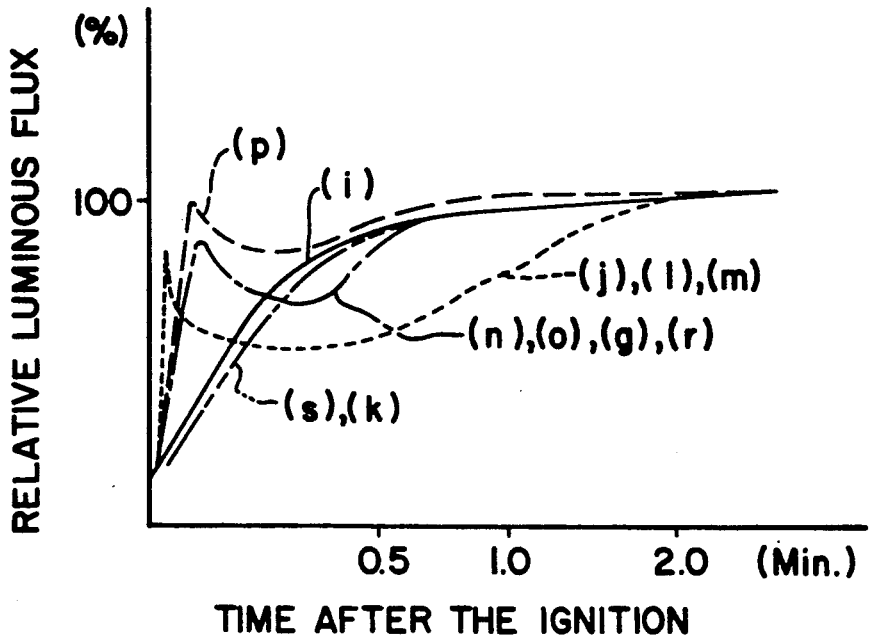
FIG. 3 is a graph showing an increasing speed of luminous flux of lamps using main amalgams and auxiliary amalgams.

Secondly, all samples were good in increasing speed of the luminous flux in the high temperature area, but samples (j), (k), (l), (m) and (s) were not good in the low and middle temperature area. FIG. 3 is a graph showing the increasing speed of the luminous flux of lamps (samples (j)–(s)) in a starting period. The increasing speeds of the luminous fluxes of the lamps shown were measured at 25° C. ambient temperature. The horizontal axis indicates time after the ignition of the lamp and the vertical axis indicates the relative luminous flux.

The luminous fluxes of the lamps using auxiliary amalgams increase rapidly once their ignited and then they decrease a little and finally increase slowly toward the maximum luminous fluxes. On the contrary, the luminous fluxes of the lamps not using auxiliary amalgams (samples (i), (k), (s)) increase slowly and directly toward the maximum luminous fluxes after their ignitions. In these cases, the luminous fluxes of the lamps only using main amalgams (samples (k), (s)) increase slower than the lamp not using any amalgams at all (samples (i)). The reason for the slow increase in luminous flux in the lamps only using main amalgams is that the mercury vapor pressures of the main amalgams are lower than that of the pure mercury.

It was observed that there was a difference among the lamps using both main amalgams and auxiliary amalgams in the increasing speed of the luminous flux of the lamp. This difference does not relate to the difference in the composition of the main amalgams, but it is thought to relate to the difference in the composition of the auxiliary amalgams. Further, there is a relation observed that the lower the auxiliary amalgam is in mercury vapor pressure, the faster the first increase of the luminous flux is, and the larger and the longer the decrease of the luminous flux after the first increase. The auxiliary amalgam emits mercury after the ignition of the lamp because it receives the heat of the filament. Accordingly, the more mercury the auxiliary amalgam emits, the faster the first increase of the luminous flux is. In this case, the lamp has too much mercury vapor emitted from the auxiliary amalgam and thus the mercury vapor pressure exceedes a reasonable value (about $6\times10^{-3}$ Torr) and it takes a long time for the main amalgam to absorb the excess of the mercury vapor. The emission of too much mercury vapor is caused by absorbing too much mercury vapor between the time the lamp is turned off and then turned on again. The absorption of too much mercury vapor before the ignition is brought about by the lower mercury vapor pressure characteristic of the auxiliary amalgam. The lower the mercury vapor pressure of auxiliary amalgam is, the more it absorbs the mercury vapor during a turned off period, and thus the more it emits the mercury vapor when it is turned on. Accordingly, the faster the first increase of the luminous flux is and the more the next decrease of the luminous flux is.

Accordingly, it is important for the auxiliary amalgam to have a mercury vapor pressure characteristic which is not too low in the low and middle temperature area as compared with that of the main amalgam.

Furthermore, it is necessary for the auxiliary amalgam to have a lower mercury vapor pressure than that of the main amalgam. If the mercury vapor pressure of the auxiliary amalgam is high, the main amalgam absorbs almost all the mercury vapor in the tube, because of the relation between the mercury vapor pressures. Therefore, the auxiliary amalgam cannot absorb and emit the mercury vapor during the turned off period, and thus, the auxiliary amalgam cannot emit the mercury vapor in the starting period after its ignition.

According to the above, it is necessary for the auxiliary amalgam to have a mercury vapor pressure not less than a third as much as the mercury vapor pressure of the main amalgam in the low and middle temperature area (0° C.- 50° C.). In other words, it is necessary for the present invention to have a suitable combination of the main amalgam and the auxiliary amalgam.

Furthermore, the electric stability corresponds to the increasing speed of the lamp. The period from the ignition of the lamp to becoming electrically stable corresponds to the period that the luminous flux become stable from the ignition of the lamp, and also to the period that the mercury vapor pressure in the tube of the lamp become stable.

Next, the tendency of the ignition characteristics of the lamps using amalgams is similar to that of the increasing speeds of the luminous fluxes of the lamps, as shown in Table II. All samples are good in the ignition characteristic in the high temperature area and the samples (j), (l) and (m) are not good in the low and middle temperature area same as in case of the increasing speed of luminous flux. The sample (p) has an intermediate characteristic in the ignition characteristic in the low and middle temperature area. The ignition characteristic depends on the mercury vapor pressure, before its ignition, which is controlled by the amalgam. When the lamp has a main amalgam and an auxiliary amalgam, the mercury vapor pressure is controlled by the amalgam which has a lower mercury vapor pressure in the low and middle temperature area. The mercury vapor pressure of the In-Hg amalgam is too low to obtain a good ignition characteristic. The mercury vapor pressure of the Bi-In-Hg amalgam is a little low. According to the above reason, the results shown in Table II were obtained.

The blackening estimation is the last item to be considered with regards to the lamps using amalgams. The estimation was made by whether or not the tube of the lamp blackened near the electrodes by the phenomenon that the auxiliary amalgam emits too much mercury vapor and the mercury vapor sticks to the inner surface of the tube, thus causing the blackening. As may be understandable according to the above, the blackening of the lamp corresponds to the ignition characteristic, as shown in Table II.

Figure 4:
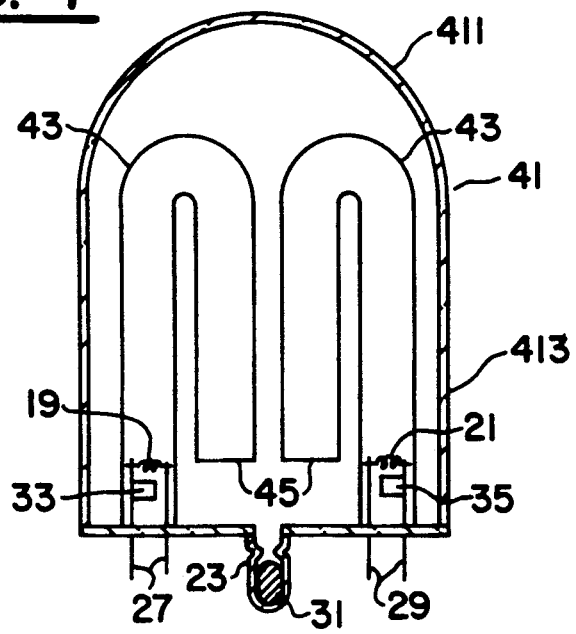
FIG. 4 is a partially sectional schematic view of a fluorescent lamp according to a second embodiment of the present invention.

The present invention is not limited to the above embodiment and may be applied to a lamp which has a outer tube 41 defining a discharge space and a pair of inner tubes 43 and 43 defining a discharge path, shown in FIG. 4. The outer tube 41 is formed in a shape which has a hemispherical shape portion 411 and a cylinderical shape portion 413. The outer tube 41 surrounds the pair of inner tubes 43 and 43 which are formed in a U-shape, respectively. The pair of inner tubes 43 and 43 have a pair of electrodes 19 and 21 at each one end thereof. Opposite ends of the inner tubes 43 and 43 have openings 45 and 45 which the discharge generated between the electrodes 19 and 21 passes through. An auxiliary amalgam 33, 35, is supported by the electrode, respectively. A main amalgam 31 is provided in a exhausted tube 23. This lamp has same advantages as the first embodiment when the present invention is applied.

In summary, it will be seen that the present invention overcomes the disadvantages of the prior art and provides lamps with main amalgams and auxiliary amalgams. Many changes and modifications in the above described embodiments can thus be carried out without departing from the scope of the present invention. Therefore, the appended claims should be construed to include all such modifications.

What is claimed is:

1. A low pressure mercury vapor discharge lamp, comprising:

a tube forming a discharge space therein, said discharge space containing a discharge gas including a mercury vapor;

a pair of electrodes provided in said tube, said pair of electrodes having a space therebetween;

a main amalgam sealed in said tube for controlling a mercury vapor pressure in said tube, said main amalgam having a mercury vapor pressure not less than a third as much as a mercury vapor pressure of pure mercury at a temperature between 0° C. and 50° C.; and an auxiliary amalgam sealed in said tube and located closer to one of said pair of electrodes than said main amalgam, said auxiliary amalgam having a composition different from that of said main amalgam and having a mercury vapor pressure less than that of said main amalgam, but not less than a third as much as said mercury vapor pressure of said main amalgam at a temperature between 0° C. and 50° C.

2. A low pressure mercury vapor discharge lamp according to claim 1, wherein said tube includes a main tube forming said discharge space therein and a thin tube connected to said main tube, said thin tube being thinner than said main tube and having said main amalgam therein.

3. A low pressure mercury vapor discharge lamp according to claim 2, wherein said electrodes are located in said main tube.

4. A low pressure mercury vapor discharge lamp according to claim 3, further comprising a plurality of lead wires supporting said electrodes and said auxiliary amalgam in said main tube.

5. A low pressure mercury vapor discharge lamp according to claim 1, wherein said main amalgam comprises mercury and a base metal comprising bismuth and lead.

6. A low pressure mercury vapor discharge lamp according to claim 5, wherein said base metal of said main amalgam has between 50 wt% and 63 wt% bismuth and between 37 wt% and 50 wt% lead.

7. A low pressure mercury vapor discharge lamp according to claim 6, wherein said main amalgam comprises mercury in an amount of more than 12 wt% of a total amount of said main amalgam.

8. A low pressure mercury vapor discharge lamp according to claim 5, wherein said auxiliary amalgam comprises mercury and a base metal comprising bismuth, indium and lead.

9. A low pressure mercury vapor discharge lamp according to claim 1, wherein said main amalgam comprises mercury and a base metal comprising bismuth and tin.

10. A low pressure mercury vapor discharge lamp according to claim 9, wherein said base metal of said main amalgam has between 50 wt% and 63 wt% bismuth and between 37 wt% and 50 wt% tin.

11. A low pressure mercury vapor discharge lamp according to claim 10, wherein said main amalgam comprises mercury in an amount of not less than 15 wt% of a total amount of said main amalgam.

12. A low pressure mercury vapor discharge lamp according to claim 9, wherein said auxiliary amalgam comprises mercury and a base metal comprising bismuth, indium and lead.

13. A low pressure mercury vapor discharge lamp according to claim 1, wherein said main amalgam comprises mercury and a base metal comprising bismuth, indium and lead.

14. A low pressure mercury vapor discharge lamp according to claim 13, wherein said auxiliary amalgam comprises mercury and a base metal comprising bismuth and indium.

15. A low pressure mercury vapor discharge lamp according to claim 1, wherein said auxiliary amalgam comprises mercury and a base metal comprising bismuth, indium and lead.

16. A low pressure mercury vapor discharge lamp according to claim 1, wherein said auxiliary amalgam comprises mercury and a base metal comprising bismuth and indium.

17. A low pressure mercury vapor discharge lamp, comprising:

a tube forming a discharge space therein, said discharge space containing a discharge gas including a mercury vapor;

means for generating said discharge gas in said tube;

a main amalgam sealed in said tube for controlling a mercury vapor pressure in said tube during a discharge period except for a starting period of said discharge period, said main amalgam having a mercury vapor pressure not less than a third as much as a mercury vapor pressure of pure mercury at a temperature between 0° C. and 50° C.; and an auxiliary amalgam sealed in said tube for emitting said mercury vapor during said starting period and for absorbing said mercury vapor during a non-discharge period, said auxiliary amalgam having a composition different from that of said main amalgam and having a mercury vapor pressure less than that of said main amalgam, but not less than a third as much as said mercury vapor pressure of said main amalgam at a temperature between 0° C. and 50° C.

* * * * *